US011009813B2

(12) United States Patent
Matsushita et al.

(10) Patent No.: US 11,009,813 B2
(45) Date of Patent: May 18, 2021

(54) IMAGE FORMING APPARATUS INCLUDING A DISPERSION UNIT

(71) Applicant: FUJI XEROX CO., LTD., Tokyo (JP)

(72) Inventors: Kaoru Matsushita, Kanagawa (JP); Koichi Sato, Kanagawa (JP); Kazutoshi Sugitani, Kanagawa (JP); Masakazu Shirai, Kanagawa (JP); Hibiki Sasaki, Kanagawa (JP); Kiyotoshi Kaneyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/834,394

(22) Filed: Mar. 30, 2020

(65) Prior Publication Data

US 2021/0072670 A1 Mar. 11, 2021

(30) Foreign Application Priority Data

Sep. 11, 2019 (JP) ..... JP2019-165554

(51) Int. Cl.
*G03G 15/16* (2006.01)

(52) U.S. Cl.
CPC ..... *G03G 15/161* (2013.01)

(58) Field of Classification Search
CPC ..... G03G 15/0189; G03G 15/161; G03G 21/0076; G03G 21/168; G03G 2215/00059; G03G 2215/1623; G03G 2221/0005
USPC ..... 399/99, 100, 101, 343, 350, 352, 357
See application file for complete search history.

(56) References Cited

U.S. PATENT DOCUMENTS

| | | | | |
|---|---|---|---|---|
| 9,014,590 | B2 * | 4/2015 | Nishimura | G03G 15/0225 399/100 |
| 9,046,866 | B2 * | 6/2015 | Sato | G03G 21/0076 |
| 9,367,020 | B1 * | 6/2016 | Rokutan | G03G 21/0017 |
| 9,575,438 | B2 | 2/2017 | Takai et al. | |

FOREIGN PATENT DOCUMENTS

| | | |
|---|---|---|
| JP | 2016-31426 A | 3/2016 |
| JP | 2016-126127 A | 7/2016 |

* cited by examiner

*Primary Examiner* — Hoan H Tran
(74) *Attorney, Agent, or Firm* — Sughrue Mion, PLLC

(57) ABSTRACT

An image forming apparatus includes: an intermediate transfer belt that carries a toner image first transferred and is rotated to transport the toner image to a second transfer position; a second transfer belt that is rotated to come into contact with the intermediate transfer belt and pass through the second transfer position of the intermediate transfer belt; a plate-like cleaning unit that comes into contact with an outer circumferential surface of the second transfer belt to clean the outer circumferential surface; and a dispersion unit that comes into contact with a portion of the outer circumferential surface of the second transfer belt to disperse toner which passes through the portion on a downstream side of the cleaning unit and on an upstream side of the second transfer position.

3 Claims, 7 Drawing Sheets

IMAGE FORMING APPARATUS INCLUDING A DISPERSION UNIT

CROSS-REFERENCE TO RELATED APPLICATIONS

This application is based on and claims priority under 35 USC 119 from Japanese Patent Application No. 2019-165554 filed on Sep. 11, 2019.

BACKGROUND

(i) Technical Field

The present disclosure relates to an image forming apparatus.

(ii) Related Art

Conventionally, there has been known a technique to clean the outer circumferential surface of a rotating endless belt by removing unnecessary toner adhering to the outer circumferential surface, for instance, the technique disclosed in Japanese Unexamined Patent Application Publication Nos. 2016-126127 (Claim 1, and FIGS. 1 and 2) and 2016-31426 (Claim 1, paragraph [0029], and FIGS. 1 and 2).

Japanese Unexamined Patent Application Publication No. 2016-126127 describes a transfer transport device and an image forming apparatus including the transfer transport device which includes a transfer unit that electrically transfers a toner image on an image carrier to a transfer material transported by an endless belt which is suspended between multiple rollers and rotated; and a cleaner that has a rubber blade for removing toner adhering to the surface of the endless belt. The rubber blade is configurated to have a tip end swingable with the endless belt, a surface with a potential after corona discharge in a specific numeric range, and a rebound resilience value in a specific range.

Japanese Unexamined Patent Application Publication No. 2016-31426 describes an image forming apparatus that transfers a toner image formed on an image carrier to an object to be transferred, and removes residual materials on the image carrier after the transfer by a cleaning blade. The image carrier includes an elastic layer, the cleaning blade is a leaf spring made of metal, and the tip end of the cleaning blade is pressed against the image carrier by the resilience of the leaf spring. In addition, Japanese Unexamined Patent Application Publication No. 2016-31426 describes that in a cleaner of an intermediate transfer belt, a brush roller or a foam roller is used as a cleaning roller disposed on the upstream side of the intermediate transfer belt in the rotational direction with respect to the cleaning blade.

SUMMARY

Aspects of non-limiting embodiments of the present disclosure relate to an image forming apparatus that can reduce the occurrence of a streak pattern on a sheet of paper after uncollected toner is transferred, by providing the toner dispersion unit described below, as compared with when the toner dispersion unit is not provided, the uncollected toner having passed through a plate-like cleaning unit and being present in a streak pattern substantially along a rotational direction of a second transfer belt, the plate-like cleaning unit being configured to come into contact with the outer circumferential surface of the rotating second transfer belt to clean the outer circumferential surface. The toner dispersion unit comes into contact with a portion of the outer circumferential surface of the second transfer belt to disperse the toner which passes through the portion on the downstream side of the cleaning unit and on the upstream side of a second transfer position.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including:

an intermediate transfer belt that carries a toner image first transferred and is rotated to transport the toner image to a second transfer position;

a second transfer belt that is rotated to come into contact with the intermediate transfer belt and pass through the second transfer position of the intermediate transfer belt;

a plate-like cleaning unit that comes into contact with an outer circumferential surface of the second transfer belt to clean the outer circumferential surface; and a dispersion unit that comes into contact with a portion of the outer circumferential surface of the second transfer belt to disperse toner which passes through the portion on a downstream side of the cleaning unit and on an upstream side of the second transfer position.

BRIEF DESCRIPTION OF THE DRAWINGS

Exemplary embodiments of the present disclosure will be described in detail based on the following figures, wherein:

FIG. 6A is a schematic perspective view illustrating the dispersion roller, and FIG. 6B is a schematic cross-sectional view taken along a line VIB-VIB of the dispersion roller of FIG. 6A.

DETAILED DESCRIPTION

Hereinafter exemplary embodiments of the disclosure will be described with reference to the drawings.

First Exemplary Embodiment

Figure 1:
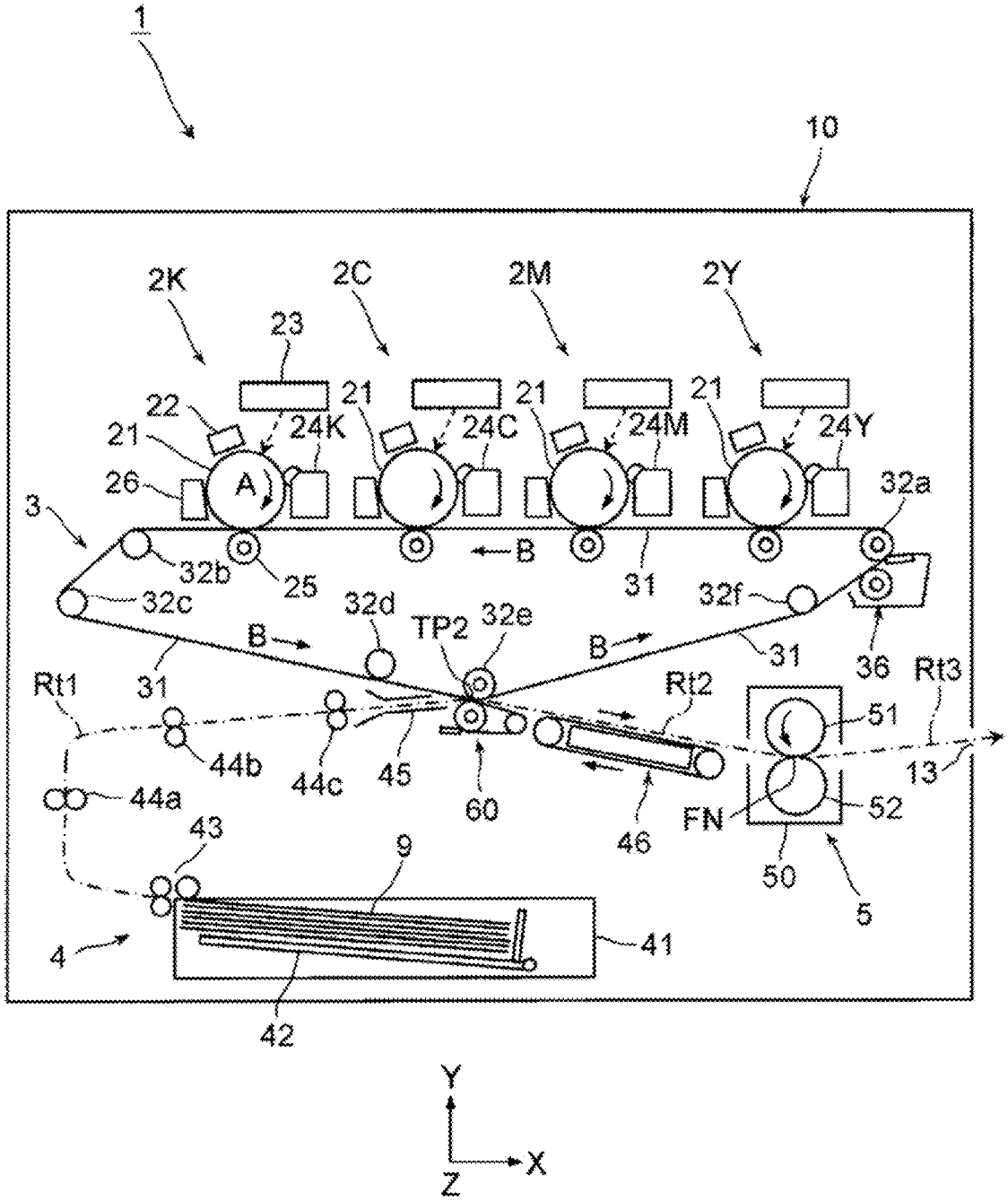
FIG. 1 is a schematic view illustrating the entirety of an image forming apparatus according to a first exemplary embodiment.
Figure 2:
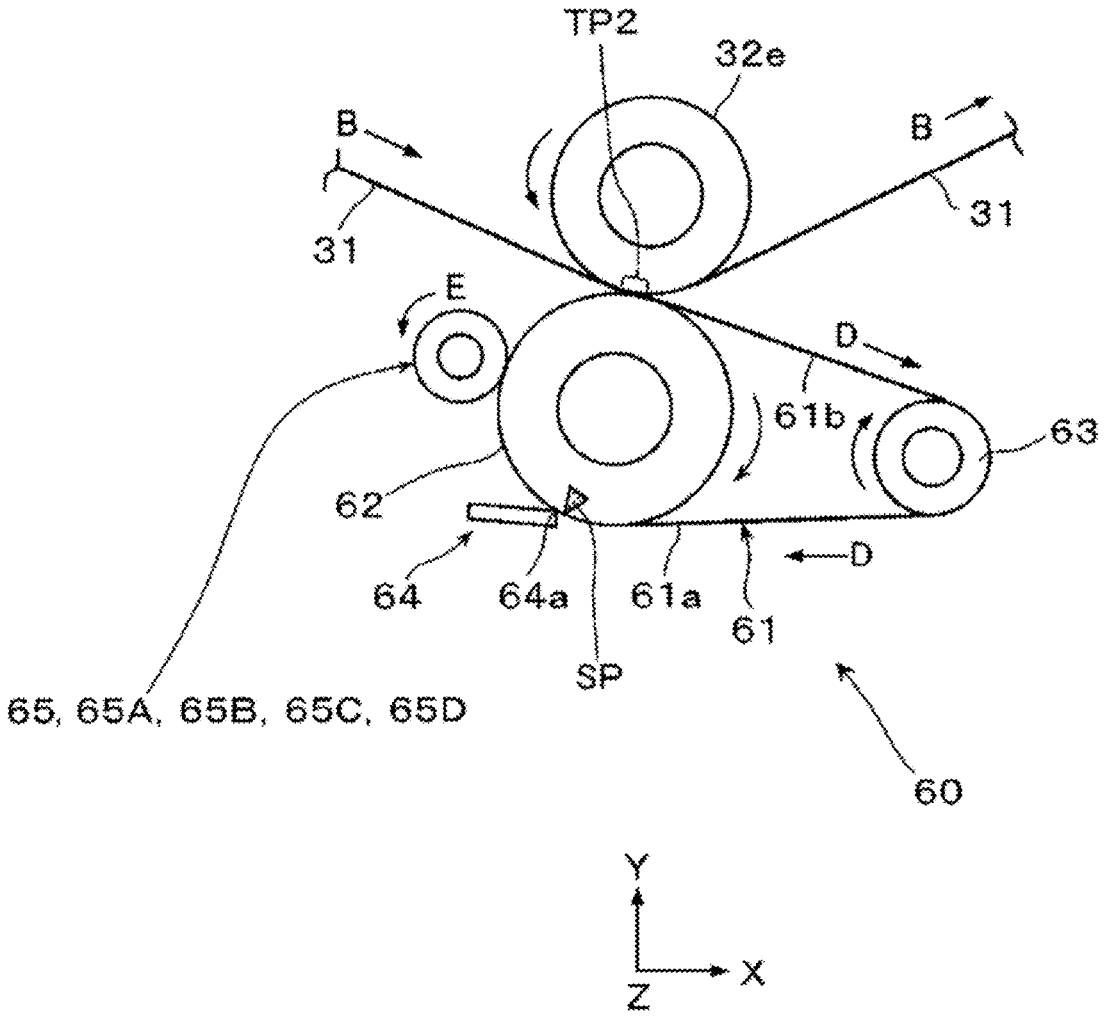
FIG. 2 is a schematic view illustrating part (primarily a second transfer device) of the image forming apparatus of FIG. 1.

FIGS. 1 and 2 are views illustrating an image forming apparatus 1 according to a first exemplary embodiment. FIG. 1 illustrates the entire configuration of the image forming apparatus 1, and FIG. 2 illustrates the configuration of part (primarily, a secondary transfer device and its peripheral area) of the image forming apparatus 1.

The arrows labeled with the symbols X, Y, Z in the drawings such as FIG. 1 indicate the directions of width, height, and depth of three-dimensional space defined in the drawings. In each of the drawings, a circle symbol at the intersection of the arrows in the X and Y (or Y and Z) directions indicates that the Z (or X) direction is toward the vertically downward of the drawing surface.

The image forming apparatus 1 is an apparatus that forms an image composed of toner as a developer on a sheet of paper 9 which is an example of a recording medium. The image forming apparatus 1 in the first exemplary embodiment is implemented as a printer that forms an image corresponding to image information inputted from an external connection device such as an information terminal device, for instance.

As illustrated in FIG. 1, in the internal space of a housing 10, the image forming apparatus 1 includes an image forming device 2 that forms a toner image based on image information; an intermediate transfer device 3 that temporarily carries the image formed by the image forming device 2 then secondarily transfers the image to the sheet of paper 9; a sheet feeding device 4 that stores and feeds sheets of paper 9 to be supplied to the position at which secondary transfer is performed by the intermediate transfer device 3; and a fixing device 5 that fixes a toner image secondarily transferred by the intermediate transfer device 3 to the sheet of paper 9.

The image information is information on an image such as a character, a figure, a photograph, and a pattern, for instance. The housing 10 is a structure formed in a desired shape with various support members and exterior materials. The dashed-dotted line with an arrow in FIG. 1 indicates a primary transport path when the sheet of paper 9 is transported within the housing 10.

The image forming device 2 includes four image forming devices 2Y, 2M, 2C, and 2K that exclusively form toner images of four colors: yellow (Y), magenta (M), cyan (C), and black (K), respectively.

Each of the four image forming devices 2 (Y, M, C, K) has a photoreceptor drum 21 which is an example of an image carrying unit that rotates in the direction indicated by an arrow A, and the image forming device 2 is formed by disposing devices, such as a charging device 22, an exposure device 23, a developing device 24 (Y, M, C, K), a first transfer device 25, and a drum cleaning device 26 in the surroundings of the photoreceptor drum 21. In FIG. 1, the symbols 21 to 26 are labeled to the image forming device 2K for black (K) only, and part of the symbols are labeled to the image forming devices (Y, M, C) for other colors.

Among all, the charging device 22 is a device that charges the outer circumferential surface (surface allowing formation of an image) of the photoreceptor drum 21 to a desired surface potential. The exposure device 23 is a device that performs light exposure on the outer circumferential surface of the photoreceptor drum 21 based on image information, and forms an electrostatic latent image having desired color components (Y, M, C, K). The developing device 24 (Y, M, C, K) is a device that develops the electrostatic latent image formed on the outer circumferential surface of the photoreceptor drum 21 with developer (toner) corresponding predetermined colors (Y, M, C, K), and forms respective toner images of the predetermined four colors. The first transfer device 25 is a device that electrostatically transfers the toner image of each color formed on the outer circumferential surface of the photoreceptor drum 21 to the intermediate transfer device 3 (an intermediate transfer belt 31). The drum cleaning device 26 is a device that scrapes and removes unnecessary toner and unwanted substances, such as paper powder, adhering to the outer circumferential surface of the photoreceptor drum 21 to clean the outer circumferential surface of the photoreceptor drum 21.

In these image forming devices 2 (Y, M, C, K), each location where the photoreceptor drum 21 (in a strict sense, an intermediate transfer belt 31 of the intermediate transfer device 3) and the first transfer device 25 are opposed to each other is a first transfer position TP1 at which the first transfer of a toner image is performed.

The intermediate transfer device 3 is a device configured to carry a toner image of each color by the first transfer, the toner image being formed by the image forming devices 2 (Y, M, C, K), then to transport the toner image to a position at which the second transfer is performed on the sheet of paper 9. The intermediate transfer device 3 is disposed on the upper side of the image forming devices 2 (Y, M, C, K) within the housing 10. Specifically, the intermediate transfer device 3 includes an intermediate transfer belt 31 to which a toner image is first transferred from each photoreceptor drum 21 of the image forming devices 2 (Y, M, C, K), and which carries the toner image, the intermediate transfer device 3 being another example of an image carrying unit. The intermediate transfer device 3 is formed by disposing the following devices around the intermediate transfer belt 31.

The intermediate transfer belt 31 is supported by multiple support rollers 32*a* to 32*f* disposed therewithin so as to pass through the first transfer positions of the image forming devices 2 (Y, M, C, K) sequentially and rotate (circumferential movement) in the direction indicated by an arrow B.

Between the multiple support rollers 32*a* to 32*f*, the support roller 32*a* is formed as a drive roller which is driven to rotate by receiving rotational power from a driving device (not illustrated), the support roller 32*b* is formed as a surface roller which holds a belt position (surface) near the first transfer position of the intermediate transfer belt 31 in cooperation with the support roller 32*a*, and the support roller 32C is formed as a tension roller. In addition, the support roller 32*d* is formed as a surface roller before the second transfer of the intermediate transfer belt 31, the support roller 32*e* is formed as a second transfer backup roller, and the support roller 32*f* is formed as a surface roller after the second transfer position of the intermediate transfer belt 31 is passed. When the support roller 32*e* is formed as a roller to which a voltage for the second transfer is supplied, the voltage for the second transfer is supplied from a power supply device which is not illustrated.

These support rollers 32*a* to 32*f* are rotatably provided in a support frame (not illustrated) of the intermediate transfer device 3.

The first transfer device 25 of each of the image forming devices 2 (Y, M, C, K) is disposed inwardly of the intermediate transfer belt 31. The first transfer device 25 configurates part of the intermediate transfer device 3, and presses the intermediate transfer belt 31 against the photoreceptor drum 21 by a first transfer member in a roll form or the like, to which a first transfer current is supplied.

A second transfer device 60 is disposed at the outer circumferential surface of a portion, supported by the support roller 32*e*, of the intermediate transfer belt 31. The second transfer device 60 allows the sheet of paper 9 to pass through and secondarily transfers a toner image on the intermediate transfer belt 31 to the sheet of paper 9. The second transfer device 60 is formed as a device in a belt form as described later.

In addition, at the outer circumferential surface of a portion, supported by the support roller 32*a*, of the intermediate transfer belt 31, a belt cleaning device 36 is disposed, which removes unwanted substances such as unnecessary toner adhering to the outer circumferential surface of the intermediate transfer belt 31 to clean the outer circumferential surface of the intermediate transfer belt 31, the belt cleaning device 36 being another example of a removal unit.

In the intermediate transfer device 3, the location where the outer circumferential surface of the intermediate transfer belt 31 is in contact with the second transfer device 60 is a second transfer position TP2 at which the second transfer of a toner image is performed.

The sheet feeding device 4 is a device configured to store and supply the sheets of paper 9 to be supplied to the second transfer position TP2 of the intermediate transfer device 3. The sheet feeding device 4 is disposed at a position on the lower side of the image forming devices 2 (Y, M, C, K) inside the housing 10, and specifically is formed by disposing devices such as a storage body 41 for sheets of paper, and a supply device 43.

The storage body 41 is a storage member having a stacking plate 42 for storing multiple sheets of paper 9 stacked in a desired orientation, and is mounted to allow an operation such as drawing the storage member to the outside of the housing 10 and loading the sheets of paper 9. The supply device 43 is a device that delivers the uppermost one of the sheets of paper 9 stacked on the stacking plate 42 of the storage body 41 one by one by sheet delivery devices such as multiple rollers. The sheet of paper 9 may be a recording medium, such as regular paper, coated paper, or thick paper, which can be transported within the housing 10 of the image forming apparatus 1, and allows transfer and fixing of a toner image. The quality and form of the recording medium is not particularly restricted.

The fixing device 5 is a device configured to fix a toner image to the sheet of paper 9, the toner image being secondarily transferred by the intermediate transfer device 3. The fixing device 5 is disposed at a lower position on the downstream side in the transport direction of the sheet of paper 9 from the second transfer position TP2 of the intermediate transfer device 3 within the housing 10, and specifically, is formed by disposing devices, such as a rotational body 51 for heating, and a rotational body 52 for pressurizing, in the internal space of a housing 50 provided with an introduction port and a discharge port for the sheets of paper 9.

The rotational body 51 for heating is a rotational body in a roll form or a belt-pad form, rotatable in the direction indicated by an arrow, and is heated so that the outer circumferential surface is maintained at a desired temperature by a heating unit which is not illustrated. The rotational body 52 for pressurizing is a rotational body in a roll form or a belt-pad form, which comes into contact with the rotational body 51 for heating under a desired pressure, and rotates by following the rotational body 51. The rotational body 52 for pressurizing may be heated by a heating unit.

In the fixing device 5, the location where the rotational body 51 for heating and the rotational body 52 for pressurizing are in contact with each other serves as a nip part (fixing processing part) FN that performs processing such as heating, pressurizing for fixing an unfixed toner image to the sheet of paper 9.

The portion of a dashed-dotted line indicated by a symbol Rt1 in FIG. 1 is a sheet feeding transport path for transporting and feeding the sheet of paper 9 in the sheet feeding device 4 to the second transfer position TP2. The sheet feeding transport path Rt1 is formed by disposing pairs of transport rollers 44*a* to 44*c* that pinch and transport the sheet of paper 9, and multiple guide members (not illustrated) that ensure the transport space for the sheet of paper 9 and guide the transport of the sheet of paper 9.

Among these rollers, the transport rollers 44*c* are each formed as a delivery roller that corrects skew of the sheet of paper 9 and delivers the sheet of paper 9 at a desired timing of the second transfer, what is called a registration roller. The guide member indicated by a symbol 45 in FIG. 1 is an introduction guide member that guides the transport of the sheet of paper 9 to the second transfer position TP2, where the sheet of paper 9 has been delivered by the transport rollers 44*c* serving as the registration roller.

In addition, the portion of a dashed-dotted line indicated by a symbol Rt2 in FIG. 1 is a relay transport path for relaying and transporting the sheet of paper 9 to the fixing device 5 after the second transfer is completed at the second transfer position TP2 of the intermediate transfer device 3. The relay transport path Rt2 is formed by disposing a suction belt transport device 46 and the like.

In addition, the portion of a dashed-dotted line indicated by a symbol Rt3 in FIG. 1 is a discharge transport path between the fixing device 5 and a discharge port 13, the discharge transport path for transporting the sheet of paper 9 after completion of fixing to the discharge port 13 for the sheet of paper 9 in the housing 10 and discharging the sheet of paper 9 to a discharge storage which is not illustrated. The discharge transport path Rt3 is formed by disposing a pair of transport rollers, discharge rollers (not illustrated), and multiple guide members (not illustrated) that guide the transport of the sheet of paper 9.

Next, the detail of the second transfer device 60 will be described.

As illustrated in FIG. 2, the second transfer device 60 includes a second transfer belt 61 which is rotated so as to come into contact with the intermediate transfer belt 31 and pass through the second transfer position TP2 of the intermediate transfer belt 31; a first roller 62 and a second roller 63 that rotatably support the second transfer belt 61; and a cleaning plate 64 that comes into contact with the outer circumferential surface of the second transfer belt 61 to clean the outer circumferential surface, the cleaning plate 64 being an example of a plate-like cleaning unit.

The second transfer belt 61 is an endless belt that separates the sheet of paper 9, which is passed through the second transfer position TP2, from the outer circumferential surface of the intermediate transfer belt 31, and transports and passes the sheet of paper 9 to the belt transport device 46 on the relay transport path Rt2.

Figure 4A:
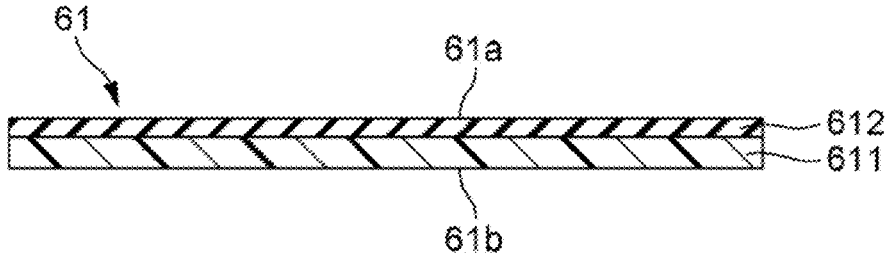
FIG. 4A is a schematic cross-sectional view illustrating the structure of a second transfer belt.
Figure 4B:
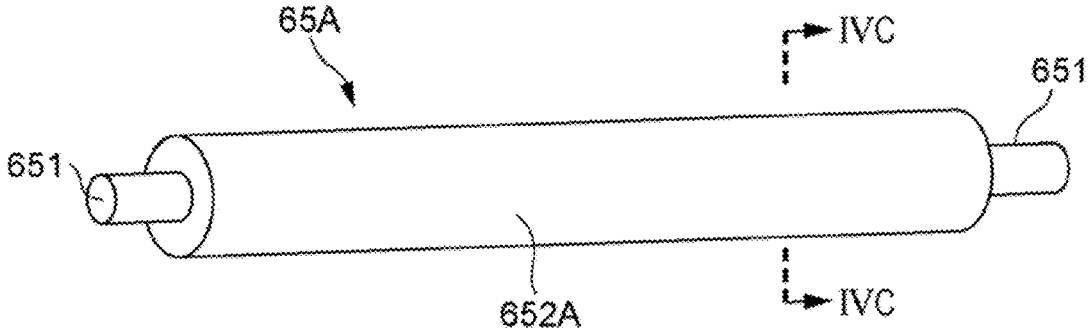
FIG. 4B is a schematic perspective view illustrating a dispersion roller.
Figure 4C:
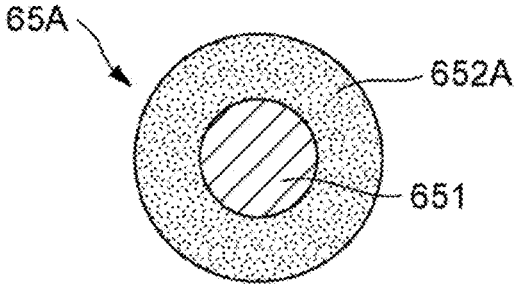
FIG. 4C is a schematic cross-sectional view taken along a line IVC-IVC of the dispersion roller of FIG. 4B.

As illustrated in FIG. 4A, the second transfer belt 61 is formed in a two-layer structure of a base material 611 and a surface layer 612 provided on one surface of the base material 611, for instance. In FIG. 4A and other figures, a symbol 61*a* and a symbol 61*b* indicate the outer circumferential surface and the inner circumferential surface of the second transfer belt 61, respectively.

It is preferable that the base material 611 be formed by containing a resin material such as a polyimide resin, a fluorinated polyimide resin, a polyamide resin, and a polyamide-imide resin. From the view point of imparting an electrical conductivity property, the base material 611 may contain an electrically conductive material, and in addition, may contain another well-known additive agent. From the view point of imparting an electrical conductivity property, the surface layer 612 comprised of an elastic layer may contain an electrically conductive material. The electrically conductive material includes electrically conductive (for instance, a volume resistivity of $10^7$ Ω·cm or less, and the same will be applied hereinafter) or electrically semi-conductive (for instance, a volume resistivity of $10^7$ Ω·cm or greater and $10^{13}$ Ω·cm or less) particles. It is to be noted that a belt member comprised of an elastic layer only in a single-layer structure may be used as the second transfer belt 61.

From the view point of achieving a favorable transfer efficiency for a sheet of paper 9 having large surface irregularities, it is preferable that only the surface layer 612 or both the surface layer 612 and the base material 611 be comprised of an elastic material to implement a second transfer belt having elasticity. It is preferable that the surface layer 612 be comprised of an elastic layer having elasticity, contain a material having elasticity (elastic material), and preferably contain a rubber material. Elastic materials used as an elastic layer include, for instance, a urethane rubber, an ethylene-propylene-diene copolymer rubber (EPDM), an epichlorohydrin rubber (ECO), an acrylonitrile-butadiene copolymer rubber (NBR), and a chloroprene rubber (CR).

In addition, the second transfer belt 61 is designed to be rotated in the direction indicated by an arrow D so as to be moved at the second transfer position TP2 in the same direction as that of the intermediate transfer belt 31 which is rotated in the direction indicated by the arrow B.

The first roller 62 is a roller that supports the second transfer belt 61 by pressing the second transfer belt 61 at the second transfer position TP2 against the outer circumferential surface of the intermediate transfer belt 31 supported by the support roller 32*e* which is a second transfer backup roller. The first roller 62 is rotatably provided in a support frame which is not illustrated. When the first roller 62 is used as a roller to which a voltage for the second transfer is supplied, the voltage for the second transfer is supplied from a power supply device which is not illustrated. In addition, the first roller 62 serves as a drive roller which is driven to rotate in the direction indicated by an arrow by receiving rotational power from a driving device which is not illustrated.

The other second roller 63 is a roller that holds the sheet of paper 9 after passing the second transfer position TP2 of the second transfer belt 61, secures the transport surface for transporting the sheet of paper 9 to the belt transport device 46, and supports the second transfer belt 61 in cooperation with the first roller 62 by applying a desired tensile force to the second transfer belt 61. The second roller 63 is a roller made of metal such as a stainless steel, and is rotatably provided in a support frame which is not illustrated.

Figure 3:
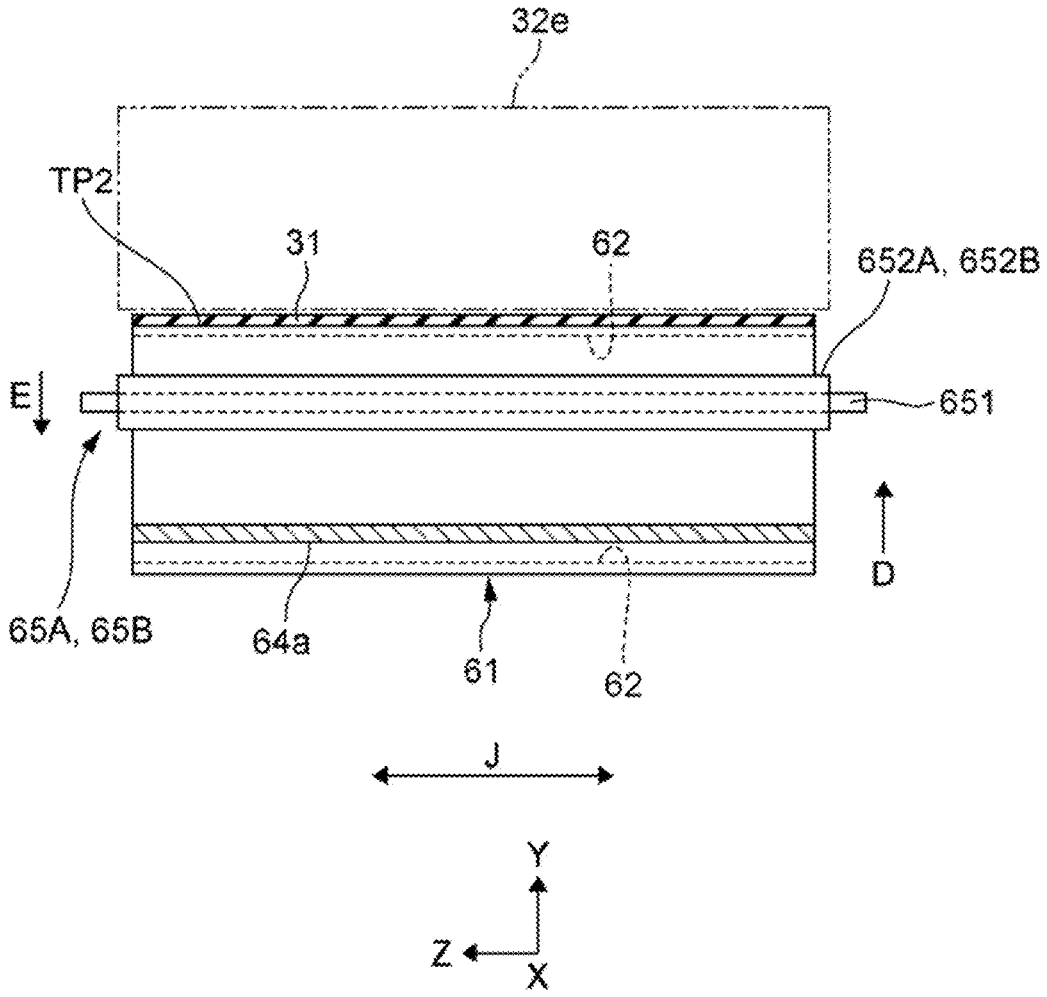
FIG. 3 is a schematic partial cross-sectional view illustrating the state of part of the image forming apparatus of FIG. 2, as viewed in a different direction.

The cleaning plate 64 is for primarily removing unwanted substances, such as toner, which are transferred from the intermediate transfer belt 31 and/or the sheet of paper 9 and adhere to the outer circumferential surface of the second transfer belt 61. The cleaning plate 64 in the first exemplary embodiment is comprised of a plate material having elasticity, the plate material being formed using a material such as a rubber. As illustrated in FIGS. 2 and 3, a tip end 64*a* of the cleaning plate 64 is mounted on a support frame (not illustrated) so as to come into contact with the outer circumferential surface 61*a* of the second transfer belt 61 at a position SP away by a desired distance from a location where the second transfer belt 61 is started to be supported by the first roller 62 in a state along a rotational shaft direction J of the second transfer belt 61 (the first roller 62).

The cleaning plate 64 is mounted on a housing (not illustrated) having a container for collecting unwanted substances such as removed toner.

When the image forming apparatus 1 starts to operate at a desired time, such as an image formation time, the second transfer device 60 operates in the following manner.

First, the second transfer belt 61 suspended over the first roller 62 and the second roller 63 starts to rotate in the direction indicated by the arrow D in synchronization with the intermediate transfer belt 31 which starts to rotate in the direction indicated by the arrow B in the intermediate transfer device 3. The second transfer belt 61 performs circular movement at the second transfer position TP2 of the intermediate transfer device 3 while being in contact with the outer circumferential surface of the intermediate transfer belt 31.

In this process, unwanted substances on the outer circumferential surface 61*a* of the second transfer belt 61 are continued to be removed during rotation of the second transfer belt 61 by the cleaning plate 64 which continues to be in contact with the outer circumferential surface 61*a*, thus the outer circumferential surface 61*a* is continued to be cleaned.

Subsequently, at the time when the second transfer is performed, the sheet of paper 9 transported from the sheet feeding device 4 through the sheet feeding transport path Rt1 is introduced between the intermediate transfer belt 31 and the second transfer belt 61 at the second transfer position TP2, and is transported in a pinched state.

In this process, when a toner image, which has been formed by the image forming devices 2 (Y, M, C, K) and first transferred, is on the outer circumferential surface of the intermediate transfer belt 31, the toner image on the outer circumferential surface of the intermediate transfer belt 31 is secondarily transferred to the sheet of paper 9 electrostatically by receiving the action of an electric field generated between the support roller 32*e* serving as a second transfer backup roller and the first roller 62.

Subsequently, the sheet of paper 9 after completion of the second transfer of the toner image is separated from the outer circumferential surface of the intermediate transfer belt 31 and is transported while being held on the outer circumferential surface 61*a* of the second transfer belt 61, and is eventually passed to the belt transport device 46 on the relay transport path Rt2.

Now, a second transfer operation performed by the second transfer device 60 on a sheet of paper 9 is completed. When a second transfer operation on multiple sheets of paper 9 is continued, the above-described second transfer operation is repeated similarly.

Figure 5A:
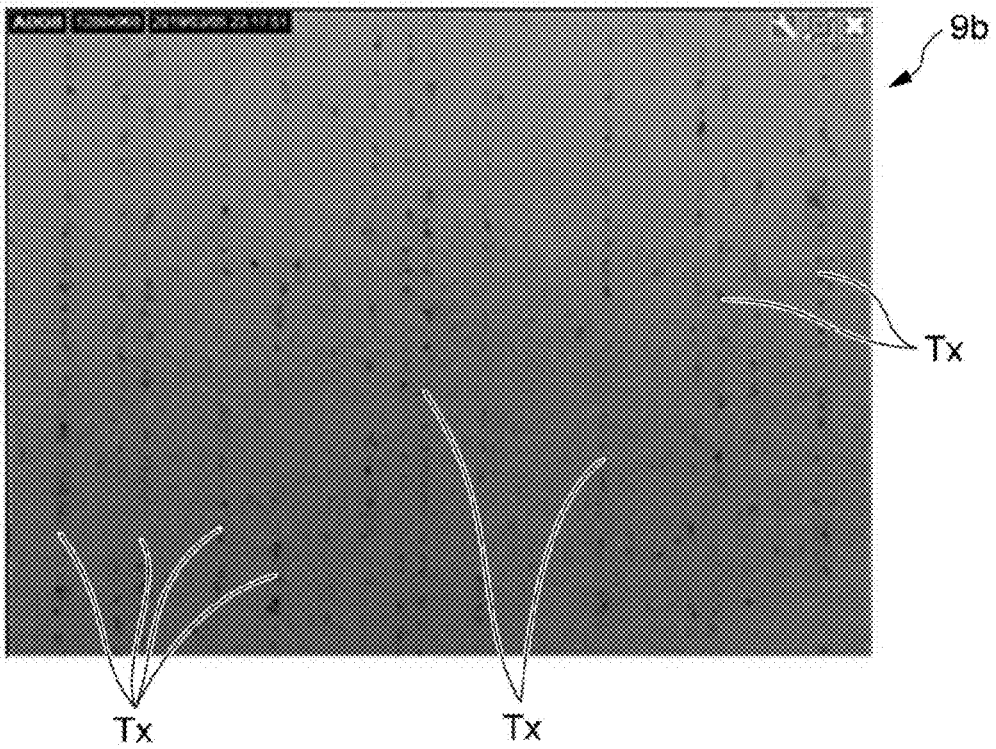
FIG. 5A is an enlarged view illustrating the state of toner smear in a streak pattern occurred on a sheet of paper when the dispersion roller is not provided.

Incidentally, in the second transfer device 60, as illustrated in FIG. 5A with a scale factor of approximately 250, uncollected toner having passed through the cleaning plate 64 disposed to be in contact with the outer circumferential surface 61*a* of the second transfer belt 61 in rotation may be moved (transferred) to the rear surface (the surface on the opposite side to a second transfer surface) 9*b* of the sheet of paper 9 in a streak pattern substantially along a rotational direction D of the second transfer belt 61.

When the uncollected toner is moved onto the rear surface 9*b* of the sheet of paper 9 in a streak pattern, the toner in a streak pattern is observed with a relatively high difference in contrasting density between the sheets of paper 9, resulting in high visibility. Thus, the toner in a streak pattern is recognizable even by naked eyes, and is likely to be visible as a problem. The portion indicated by a symbol Tx in FIG. 5A is part of the uncollected toner observed in a streak pattern.

Such a problem of transfer of uncollected toner to the rear surface 9*b* of the sheet of paper 9 in a streak pattern tends to occur significantly particularly when a belt having elasticity is used as the second transfer belt 61.

Specifically, in the second transfer belt 61 having elasticity, surface irregularities (so-called tension lines) in a streak pattern may occur because a tensile force is locally applied due to occurrence of crack of the outer circumferential surface 61*a* in the course of time and/or misalignment (displacement of the shaft center) of the rollers 62, 63 that support the second transfer belt 61. Such a phenomenon has an effect on the cleaning plate 64 as an external disturbance, and passing through of the toner is likely to be induced.

Thus, in the second transfer device 60 of the image forming apparatus 1 according to the first exemplary embodiment, as illustrated in FIGS. 2 and 3, a dispersion roller 65 is provided, which is an example of a dispersion unit that comes into contact with a portion of the outer circumferential surface 61*a* of the second transfer belt 61 to disperse the toner which passes through the portion on the downstream side of the cleaning plate 64 and on the upstream side of the second transfer position TP2.

As illustrated in FIGS. 2 and 3, the dispersion roller 65 is formed as a dispersion roller that is rotated in the direction indicated by an arrow E in contact with the outer circumferential surface 61*a* of the second transfer belt 61 which is rotated in the direction indicated by an arrow D.

As illustrated in FIGS. 2 to 4B and 4C, a foam roller 65A including a rotational shaft 651 provided with a foam layer 652A is used as the dispersion roller 65.

The foam layer 652A is comprised of an elastically deformable material such as a urethane foam, and is provided as a layer having a surface continuous in the shaft direction of the rotational shaft 651. The foam layer 652A has a surface which is relatively hard in physical property. For instance, the sole foam (original foam) has a hardness of approximately 250 to 400.

In addition, the surface of the foam layer 652A has fine irregularities. Furthermore, the foam layer 652A is configured such that at least the surface layer has an electrical conductivity.

The dispersion roller 65 is disposed substantially along the rotational shaft direction J of the second transfer belt 61 (the first roller 62) at a desired position selected from a portion of the range of the second transfer belt 61, suspended over and supported by the first roller 62, the portion being from the position with which the cleaning plate 64 is in contact extending to the second transfer position TP2 in the rotational direction D. In the disposition, as illustrated in FIG. 3, it is sufficient that the dispersion roller 65 comprised of the foam roller 65A be formed such that the foam layer 652A is in contact with at least the entirety of the width (the dimension along the rotational shaft direction J) of the second transfer belt 61.

Also, for instance, from the viewpoint of achieving a stable state of contact with the outer circumferential surface 61*a* of the second transfer belt 61, the dispersion roller 65 is disposed so as to be in rotatably contact with the outer circumferential surface 61*a* of the second transfer belt 61 supported by the first roller 62 with a desired pressure elastically applied to the outer circumferential surface 61*a*.

Figure 5B:
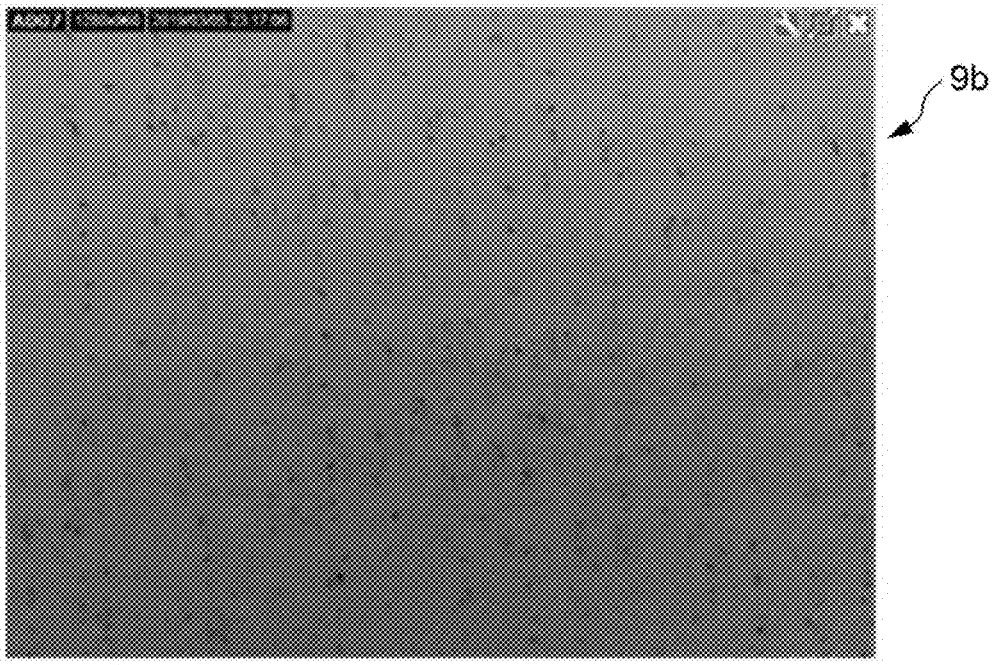
FIG. 5B is an enlarged view illustrating the effect of reduction in toner smear in a streak pattern when the dispersion roller is provided.

When the image forming apparatus 1 including the second transfer device 60 provided with the dispersion roller 65 is operated, as illustrated in FIG. 5B on a large scale, the presence of toner (Tx in FIG. 5B) in a freak pattern transferred from the intermediate transfer belt 31 is not recognized by naked eyes on the rear surface 9*b* of the sheet of paper 9 which has passed through the second transfer position TP2 as well as in the second transfer device 60. The result illustrated in FIG. 5B is the result obtained when the second transfer device 60 (not provided with the dispersion roller 65) for which the result of FIG. 5A is obtained is provided with the dispersion roller 65.

It is to be noted that due to the fact that FIG. 5B illustrates the result with the same magnification scale as that of FIG. 5A, toner adhering to the rear surface 9*b* of the sheet of paper 9 in a scattered manner can be recognized. However, when adhering of toner is checked by naked eyes, the result is almost an unrecognizable state.

Based on what has been described above, in the image forming apparatus 1, when uncollected toner formed in a streak pattern passes through the dispersion roller 65, the toner assumes a scattered state, the uncollected toner having passed through the cleaning plate 64 in the second transfer device 60 provided with the dispersion roller 65. As a consequence, the difference in contrasting density of the toner transferred to the sheet of paper 9 is reduced, and it is presumed that the toner has low visibility to a degree unrecognizable by naked eyes.

Therefore, with the image forming apparatus 1 including the second transfer device 60 provided with the dispersion roller 65, the occurrence of transfer of uncollected toner in a streak pattern to the sheet of paper 9 in a streak pattern is reduced, as compared with when the dispersion roller 65 serving as the above-described dispersion unit is not provided, the uncollected toner having passed through the cleaning plate 64 on the outer circumferential surface 61*a* of the second transfer belt 61 in rotation.

Other Exemplary Embodiments

The present disclosure is not limited to the contents illustrated in the first exemplary embodiment, and, for instance, may include the modifications as described below.

As illustrated in FIGS. 2, 3, 6A and 6B, a brush roller 65B, in which the rotational shaft 651 is provided with a hair layer 653A, may be used as the dispersion roller 65 serving as the dispersion unit.

Figure 6A:
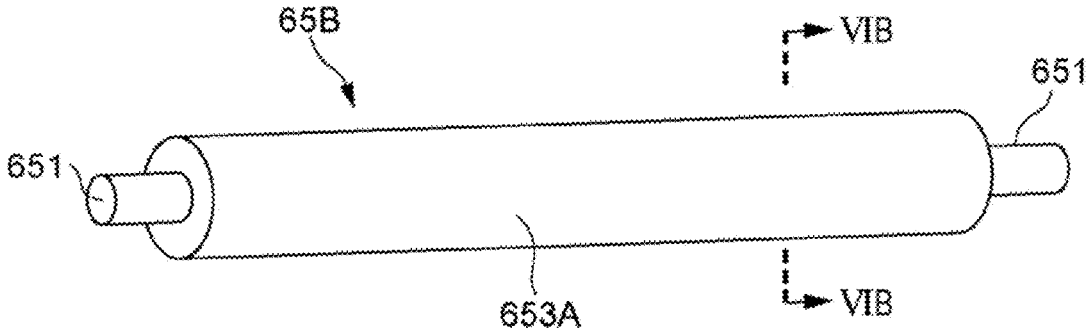
FIGS. 6A and 6B illustrate another configuration example of the dispersion roller.
Figure 6B:
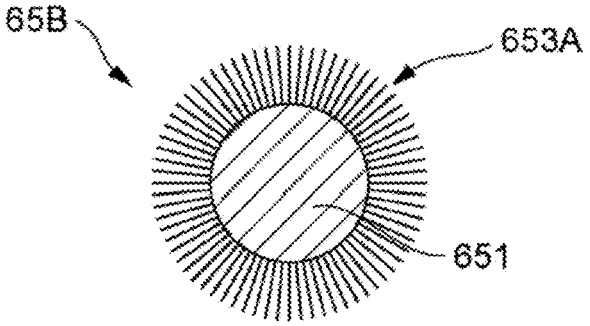

As illustrated in FIG. 6B, the hair layer 653A in the brush roller 65B is comprised of a great number of hairs, and is provided as a layer of hairs in a substantially uniform manner continuously in the shaft direction of the rotational shaft 651. The hair layer 653A can be provided, for instance, by mounting a base fabric planted with hairs so as to wind around the circumferential surface of the rotational shaft 651 and fixing the base fabric.

The height of the hair layer 653A from the rotational shaft 651 is preferably in the order of 2 to 3 mm.

In addition, for instance, from the viewpoint of making the toner unlikely to be caught, at least the portion of the hairs has non-electrical conductivity.

Similarly to the case of the dispersion roller 65 comprised of the foam roller 65A in the first exemplary embodiment, the dispersion roller 65 comprised of the brush roller 65B is disposed substantially along the rotational shaft direction J of the second transfer belt 61 at a desired position selected from a specific portion of the second transfer belt 61. In this process, similarly to the case of the dispersion roller 65 comprised of the foam roller 65A (FIG. 3), it is sufficient that the hair layer 653A be formed to come in contact with at least the entirety of the width of the second transfer belt 61.

From the viewpoint of achieving a stable state of contact with the outer circumferential surface 61*a* of the second transfer belt 61, the dispersion roller 65 comprised of the brush roller 65B is disposed to be in contact with the outer circumferential surface 61*a* with the hairs of the hair layer 653A slightly curved and bent.

In the image forming apparatus 1 to which the dispersion roller 65 comprised of the brush roller 65B is applied, the uncollected toner present in a streak pattern on the outer circumferential surface 61*a* is scattered without changing the rotation of the second transfer belt 61, as compared with when the dispersion roller 65 is not comprised of the brush roller 65B.

Figure 7:
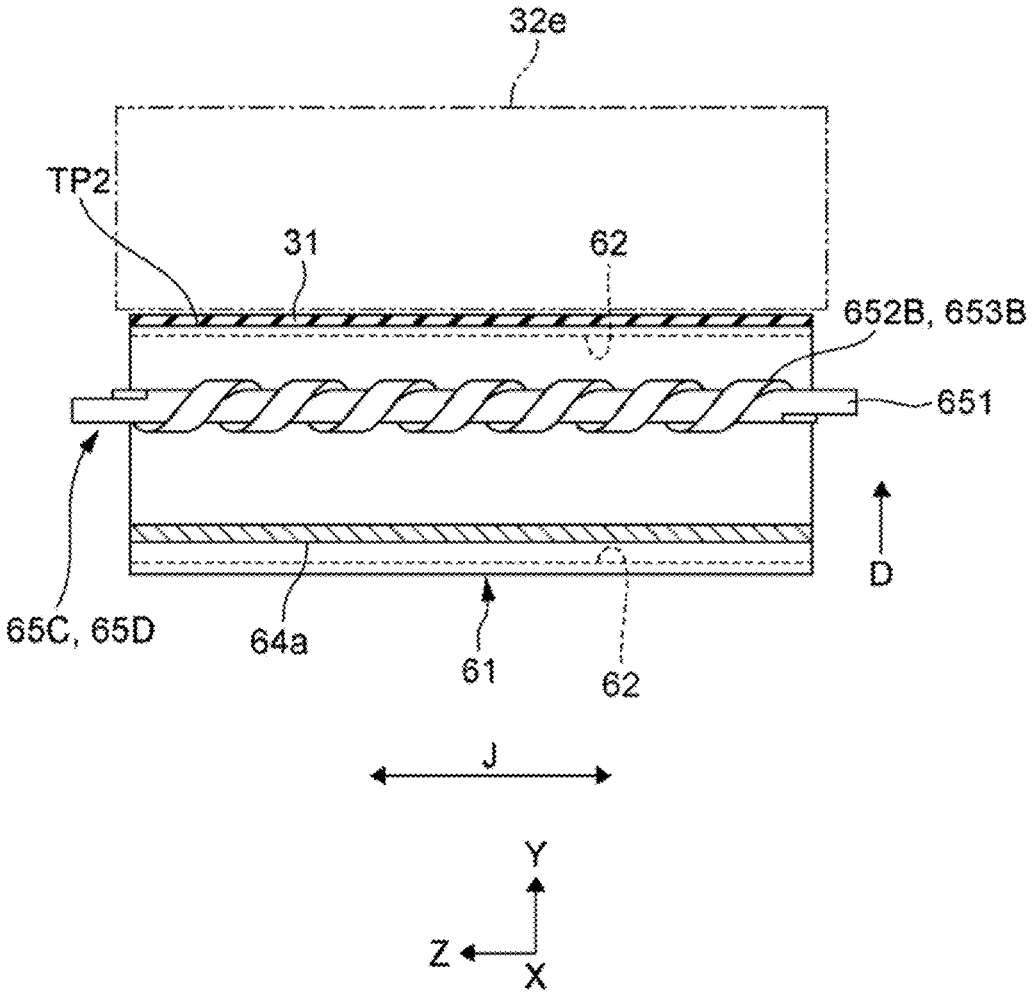
FIG. 7 is a schematic partial cross-sectional view illustrating a second transfer device to which a dispersion roller in another configuration is applied.

As illustrated in FIGS. 2 and 7, a spiral foam roller 65C, in which the foam layer 652A is provided spirally wound around the rotational shaft 651, may be used as the dispersion roller 65 serving as the dispersion unit, or alternatively, a spiral brush roller 65D, in which the hair layer 653A is provided spirally wound around the rotational shaft 651, may be used as the dispersion roller 65 serving as the dispersion unit.

When the spiral foam roller 65C or the spiral brush roller 65D is used, the conditions related to the spiral of the foam layer 652A and the hair layer 653A are arbitrarily set from the viewpoint of a functional effect of scattering toner. In particular, the state of spiral is not limited to the state of spiral winding with an interval as illustrated in FIG. 7, and may be a state of spiral winding in contact with each other without an interval.

Installation of the dispersion roller 65 comprised of the spiral foam roller 65C or the spiral brush roller 65D is substantially the same as that of the case of the foam roller 65A in the first exemplary embodiment and the brush roller 65B in the modification described above.

In the image forming apparatus 1 including the second transfer device 60 to which the dispersion roller 65 comprised of the spiral foam roller 65C or the spiral brush roller 65D is applied, a dispersion effect due to spiral contact with the outer circumferential surface 61*a* of the second transfer belt 61 is obtained, as compared with the case of the foam roller or the brush roller in which the foam layer 652A or the hair layer 653A is not spirally provided, thus the uncollected toner present in a streak pattern is scattered and displaced in the rotational shaft direction J of the second transfer belt 61.

In particular, in the image forming apparatus 1 including the second transfer device 60 to which the dispersion roller 65 comprised of the spiral brush roller 65D is applied, the uncollected toner present in a streak pattern can be scattered and displaced in the rotational shaft direction J of the second transfer belt 61 without changing the rotation of the second transfer belt 61, as compared with when the spiral foam roller 65C is applied.

In addition, a form other than the roll form may be used as the dispersion unit. The dispersion unit is not limited to the unit that is rotated by following the rotation of the second transfer belt 61, and may be a unit (such as a contact film, a contact brush) solely configured to come into contact with the outer circumferential surface 61*a* of the second transfer belt 61.

Alternatively, the dispersion unit may be provided separably from the outer circumferential surface 61*a* of the second transfer belt 61. When the dispersion unit is configurated in such a manner, for instance, at the time when the second transfer belt 61 is not rotated, the dispersion unit can be in a state of being separated from the outer circumferential surface 61*a* of the second transfer belt 61, and thus the occurrence of unnecessary deformation of the dispersion unit and adherence of toner can be reduced.

It is sufficient that the second transfer device 60 include the second transfer belt 61 which is rotated; the plate-like cleaning unit represented by the cleaning plate 64; and the dispersion unit represented by the dispersion roller 65. The configuration other than this, including the conditions for the number and quality material of components may be arbitrarily changed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an intermediate transfer belt configured to carry a toner image first transferred and configured to rotate to transport the toner image to a second transfer position;

a second transfer belt configured to rotate to contact the intermediate transfer belt and pass through the second transfer position;

a plate-like cleaning unit configured to contact an outer circumferential surface of the second transfer belt to clean the outer circumferential surface; and a dispersion unit configured to contact a portion of the outer circumferential surface of the second transfer belt to disperse toner which passes through the portion on a downstream side of the cleaning unit and on an upstream side of the second transfer position, wherein the dispersion unit comprises a dispersion roller configured to rotate by following the second transfer belt, wherein the dispersion roller comprises a rotational shaft provided with a foam layer comprising an elastically deformable material, and wherein the foam layer is provided as a layer having a surface continuous in a shaft direction of the rotational shaft.

2. The image forming apparatus according to claim 1, wherein the foam layer has a surface which has a hardness of approximately 250 to 400.

3. An image forming apparatus comprising:

an intermediate transfer belt configured to carry a toner image first transferred and to rotate to transport the toner image to a second transfer position;

a second transfer belt configured to rotate to contact the intermediate transfer belt and configured to pass through the second transfer position;

a plate-like cleaning means for contacting an outer circumferential surface of the second transfer belt to clean the outer circumferential surface; and a dispersion means for contacting a portion of the outer circumferential surface of the second transfer belt to disperse toner which passes through the portion on a downstream side of the plate-like cleaning means and on an upstream side of the second transfer position, wherein the dispersion means comprises a dispersion means for rotating by following the second transfer belt, wherein the dispersion means comprises a rotational shaft provided with a foam layer comprising an elastically deformable material, and wherein the foam layer is provided as a layer having a surface continuous in a shaft direction of the rotational shaft.

* * * * *